US005879721A

United States Patent [19]

Bradley

[11] Patent Number: 5,879,721

[45] Date of Patent: Mar. 9, 1999

[54] MOVABLE POURING BASIN

[75] Inventor: Earl T. Bradley, Eastland, Tex.

[73] Assignee: EBAA Iron, Inc., Eastland, Tex.

[21] Appl. No.: 704,024

[22] Filed: Aug. 28, 1996

[51] Int. Cl.[6] ..... B22C 9/20

[52] U.S. Cl. ..... 425/218; 164/130; 164/134; 164/136; 425/256; 425/261

[58] Field of Search ..... 425/256, 259, 425/261, 218, 447, 453; 164/136, 130, 134, 323, 335

[56] References Cited

U.S. PATENT DOCUMENTS

| | | | |
|---|---|---|---|
| 602,614 | 4/1898 | Baker . | |
| 2,380,751 | 7/1945 | Gowland | 164/322 |
| 3,920,013 | 11/1975 | Bodzin . | |
| 3,991,815 | 11/1976 | Fastner et al. . | |
| 3,996,996 | 12/1976 | Gunnergaard | 164/323 |
| 4,064,925 | 12/1977 | Fastner et al. . | |
| 4,243,093 | 1/1981 | Nieman | 164/96 |
| 4,250,944 | 2/1981 | Möring | 164/54 |
| 4,509,578 | 4/1985 | Shaw . | |
| 4,546,812 | 10/1985 | Tiegel | 164/130 |
| 4,576,217 | 3/1986 | Shaw . | |
| 4,576,220 | 3/1986 | Smyth et al. . | |
| 4,708,326 | 11/1987 | Brockmeyer et al. . | |
| 4,749,019 | 6/1988 | Sorrell et al. | 164/130 |
| 4,819,840 | 4/1989 | Lax et al. . | |
| 4,832,111 | 5/1989 | Riethmann et al. | 164/457 |
| 4,953,762 | 9/1990 | Villani . | |
| 4,982,778 | 1/1991 | Weimann . | |
| 5,255,731 | 10/1993 | Yun | 164/135 |
| 5,335,711 | 8/1994 | Paine . | |

OTHER PUBLICATIONS

Article: "The Challenge Never Ends for Continuous Improvement," Globe Metallurgical Sales, Inc., undated.

*Primary Examiner*—Jay H. Woo
*Assistant Examiner*—Iurie A. Schwartz
*Attorney, Agent, or Firm*—Akin, Gump, Strauss, Hauer & Feld, L.L.P.; Randall C. Brown; Rick Matos

[57] ABSTRACT

A movable pouring basin including a funnel-type sprue for use with a casting machine is aligned between a source of molten casting material and the downsprues of molds on an assembly line moving beneath the source of molten casting material.

28 Claims, 2 Drawing Sheets

FIG. 2
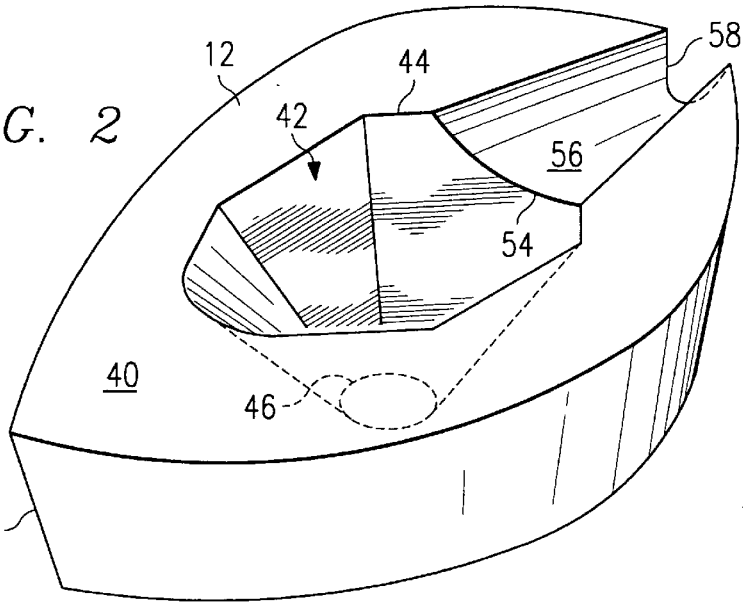
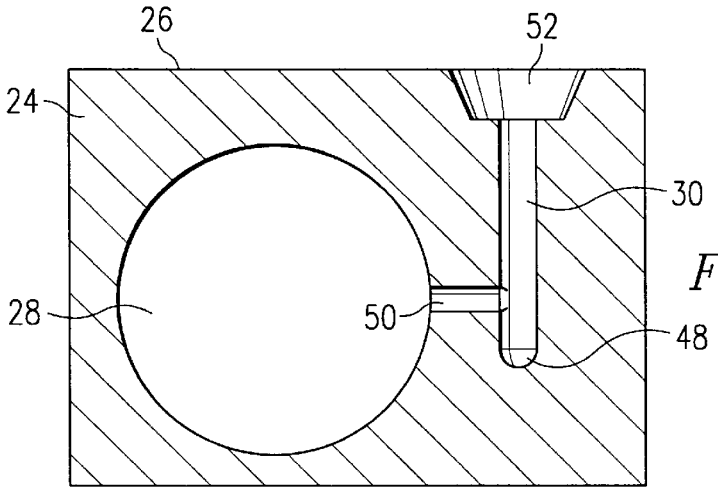
FIG. 3
FIG. 4
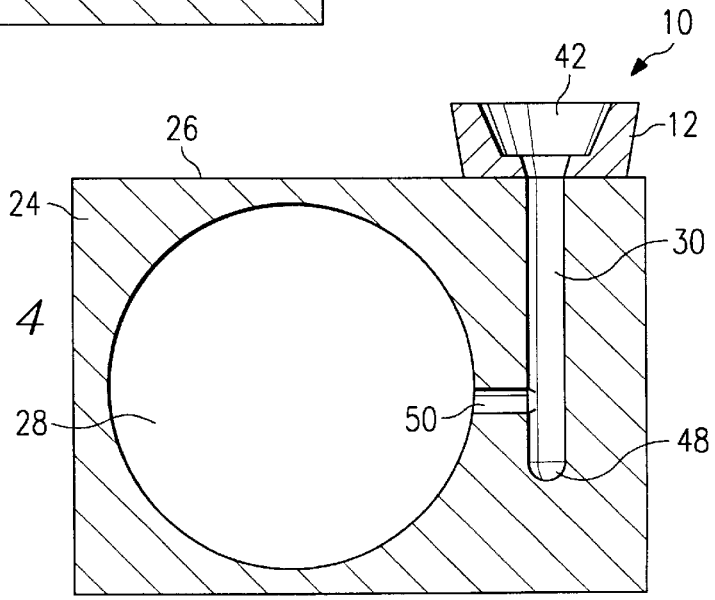

MOVABLE POURING BASIN

BACKGROUND OF THE INVENTION

1. Field of the Invention

The present invention relates to a movable pouring basin for use in connection with dispensing molten materials including metals and castable plastic from a vessel into casting cavities moving beneath the vessel. The movable pouring basin has particular utility in connection with metal casting in vertically parted green-sand molds, and when used in connection with a "Disamatic" or "Koyo-type" automatic molding machine.

A description of the Disamatic machine may be found in U.S. Pat. No. 4,749,019 to Sorrell et al., the entire disclosure of which is incorporated herein by reference.

2. Description of Related Information

Mass manufacturing of cast parts may be accomplished by releasing molten casting material into a mold line disposed on a pouring table that "indexes" beneath the casting material source. The mold line comprises a series of casting cavities, each having a passage known as the "downsprue" through which the casting material is introduced into the cavity.

In a typical arrangement, the molten casting material is held in a vessel disposed above the mold line. The vessel comprises an effluent spout which may be alternately opened or closed using a stopper rod. As the pouring table aligns the downsprue of each casting cavity beneath the spout, the pouring table pauses, the stopper rod is lifted, and molten casting material is dispensed. When the mold is full, the stopper rod is lowered to stop the release of casting material, and the pouring table indexes to the next casting cavity. The position of the vessel or spout may be adjustable to facilitate alignment of the spout and a given downsprue.

In lieu of the automated pouring process, the casting cavities can be filled by other means including, for example, the use of a manual, semi-automatic, or automatic tilt ladle. The casting process may also be adapted to cooperate with the well-known Disamatic machine, in that the casting material source and pouring table may be timed to operate at a cycling rate that corresponds to that of the Disamatic machine.

The Disamatic machine produces molds of the "door and ram" type. These molds have two embossed surfaces, i.e., a front surface and a rear surface. The front embossed surface, referred to as the "door half," embodies one-half of a casting cavity and one half of the associated downsprue. The rear embossed surface, referred to as the "ram half," embodies the second half of a cavity and downsprue.

In the mold line, the door half of a first mold will abut the ram half of a second mold to form a complete cavity and downsprue. The respective door halves and ram halves of the molds formed in this manner do not function as separate and distinct molds because any given door or ram half can only create a cavity and downsprue in cooperation with an adjacent door or ram half.

Regardless of the casting system employed, it is undesirable for molten casting material which is being poured into the downsprue of the mold to be splashed, overflowed, or inadvertently introduced into an adjacent mold. Among other adverse effects, this can lead to quality control problems when the splashed or overflowed casting material cools on top of the molds or cools prematurely in an adjacent mold cavity.

In order to reduce these effects, foundries typically have employed a downsprue that is characterized by a funnel-type pouring basin located at the top of the mold (the "integral funnel") in order to provide a reasonably large target for the falling molten casting material. However, the integral funnel limits the size of the casting that can be made for given mold dimensions. In addition, the integral funnel must be filled with molten casting material in order to generate a sufficient head pressure to completely fill the casting cavity, resulting in wasted material which must be remelted before reuse. Thus, the use of integral funnels increases the amount of casting material required to make a given number of finished castings.

A need exists, therefore, for a simple, robust and inexpensive device that can reduce the adverse effects of splashing and overfill as does the integral funnel, but that increases yield by reducing the amount of waste metal associated with each casting.

SUMMARY OF THE INVENTION

The apparatus of the present invention overcomes the above-mentioned disadvantages and drawbacks which are characteristic of the related information.

The movable pouring basin of the present invention comprises a body having a funnel-shaped sprue passing therethrough. The movable pouring basin is disposed below the effluent spout of a molten casting material vessel, and glides along the top of the advancing mold line such that the sprue of the movable pouring basin is sequentially aligned over each advancing mold downsprue.

When aligned, the downsprue of each sequential mold is simultaneously disposed beneath the sprue of the movable pouring basin and the effluent spout of the vessel. As a result, the molds do not require an integral funnel.

The "front" of the movable pouring basin faces the advancing mold line and has a generally pointed profile which, in a preferred embodiment, is formed as part of a generally canoe-shaped profile. The body is preferably formed of iron and the funnel is preferably lined with a ceramic material.

In another preferred embodiment of the present invention, the alignment of the movable pouring basin below the vessel is maintained using an arm pivotally attached between the movable pouring basin and the support structure for the vessel. The pivotal connection allows the movable pouring basin to be lifted and lowered as needed. A pneumatic device may also be employed to facilitate lifting or lowering the pivot arm, or to press the movable pouring basin firmly against the molds during operation.

In still another preferred embodiment of the present invention, an overflow channel is disposed within the movable pouring basin and connected to the inlet of the funnel-shaped sprue for capturing excess molten casting material as needed in the event of an overpour, thereby preventing the inadvertent introduction of molten casting material into an adjacent advancing mold.

In still another preferred embodiment of the present invention, a "V"-shaped vacuum is disposed at or near the front of the movable pouring basin to remove any loose sand that might otherwise be pushed into oncoming downsprues.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

BRIEF DESCRIPTION OF THE DRAWINGS

FIG. 2 is a perspective view of a movable pouring basin according to the present invention;

FIG. 3 is a cross-section showing a casting cavity connected to a conventional sprue and debris trap by a horizontal connection; and FIG. 4 is a cross-section of a casting cavity showing the movable pouring basin of the present invention and a conventional sprue and debris trap connected to the casting cavity by a horizontal connection.

DESCRIPTION OF THE PREFERRED EMBODIMENTS

Figure 1:
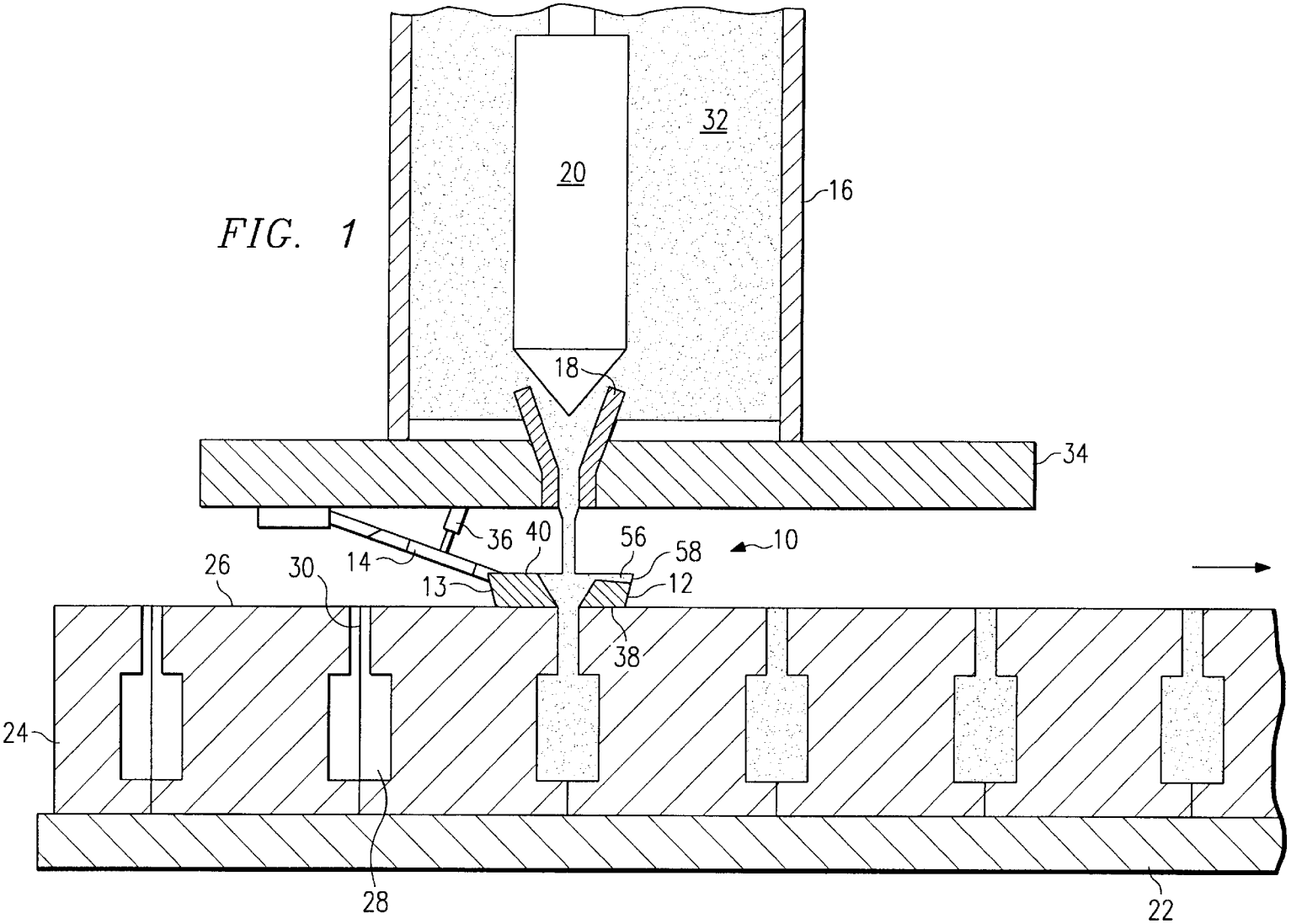
FIG. 1 is a cross-section of the movable pouring basin of the present invention shown in conjunction with a casting material source, mold line, casting cavity and pouring table.

Referring now to the drawings, a preferred embodiment of a movable pouring basin according to the present invention is shown and generally designated by the reference numeral 10.

In a preferred embodiment, the movable pouring basin 10 comprises a body 12 having a generally pointed front profile 13, and preferably made of a metal such as iron. As shown in FIG. 1, the movable pouring basin 10 of the present invention may be used in connection with a casting material vessel 16 and is preferably connected thereto by a pivot arm 14.

In conventional manner, the vessel 16 comprises an effluent spout 18 which may be alternately opened or closed using a stopper rod 20, and a pouring table 22 which travels pausably beneath the spout 18. A plurality of adjacent mold halves 24, each having a flat upper surface 26, are arranged side-by-side on the pouring table 22 and move beneath the spout 18 in the direction of the arrow shown in FIG. 1.

Each adjacent pair of mold halves 24 combine to form a casting cavity 28 and a downsprue 30, wherein the downsprue 30 extends into the casting cavity 28 from the flat surface 26 of the mold halves 24 so as to provide a vertical passage through which casting material 32 may be introduced into the casting cavity 28. Each casting cavity 28 is initially empty and indexes in the direction of the arrow shown in FIG. 1 toward a position directly beneath the vessel 16.

Those of ordinary skill in the art will recognize that the casting material 32 is initially molten, but will cool and solidify after pouring.

The body 12 of the movable pouring basin (shown in FIGS. 1 and 2) is aligned below the spout 18 and glides over the flat upper surfaces 26 of the molds 24 as they move beneath it. The alignment of the body 12 beneath the spout 18 of the vessel 16 is preferably maintained using the pivot arm 14, which extends from a pivotal connection at the body 12 to a pivotal connection at the understructure 34 of the vessel 16.

Those of ordinary skill in the art will recognize that the pivotal connections may be made using tapped holes, through holes, or threaded holes in the vessel understructure 34 and the body 12, along with mating connections on the pivot arm 14. Those of ordinary skill in the art will also recognize that there are many other suitable methods of maintaining the alignment of the body 12 beneath the effluent spout 18.

In a preferred embodiment, the body 12 may be lowered or raised using a pneumatic device 36 disposed between the vessel understructure 34 and the pivot arm 14. Pneumatically assisted vertical adjustment may be desirable to press the body 12 firmly against the flat upper surfaces 26 of the molds 24 or to lift the body 12 off the molds 24 to allow any molten casting material 32 disposed therein to drain out to prevent the solidification of the molten casting material in case the production line is suspended or stopped.

The body 12 has a bottom surface 38 and a top surface 40. To capture and direct molten casting material 32 falling from the effluent spout 18, a funnel-shaped sprue 42 extends from an inlet 44 at the top surface 40 of the body 12 to a relatively narrower outlet 46 at the bottom surface 38 of the body 12. In a preferred embodiment of the present invention, the funnel-shaped sprue 42 is lined with a ceramic material.

When in use, the inlet 44 of the sprue 42 is aligned below the effluent spout 18. The outlet 46 is aligned over the downsprues 30 of successive mold halves 24 as the pouring table 22 advances in the direction of the arrow shown in FIG. 1, and alignment may be facilitated by providing for independent motion of the vessel 16 or spout 18.

In operation of the movable pouring basin 10 of the present invention, the body 12 rests on the flat upper surfaces 26 of the advancing mold halves 24. The body 12 may also be pressed against the mold halves 24 using the pneumatic assist 36. The pouring table 22 indexes the mold line beneath the body 12 in the direction of the arrow shown in FIG. 1, and as the downsprue 30 of casting cavity 28 is indexed under the spout 18 and sprue 42, the advancing pouring table 22 pauses and the stopper rod 20 is lifted. Molten casting material 32 is dispensed from the spout 18 into the sprue inlet 44, through the sprue outlet 46, and into the downsprue 30 of the casting cavity 28.

The front 13 of the body 12 advantageously has a generally pointed horizontal cross-section so that it tends to move debris aside as the mold line indexes beneath it, rather than tending to accumulate such debris and push it into an advancing casting cavity 28. In a preferred embodiment, the horizontal cross-section of the body 12 is generally canoe-shaped.

Those of ordinary skill in the art will recognize that to further reduce the opportunity for debris to enter an unfilled casting cavity 28, the downsprues 30 may be equipped with debris traps 48 as shown in FIGS. 3 and 4. A debris trap 48 may be formed by extending the downsprue 30 below a horizontal connection 50 to the casting cavity 28 such that debris falls into the trap 48 rather than traveling into the casting cavity 28. Alternatively or additionally, a V-shaped vacuum (not shown) may be installed at or near the front profile 13 of the body 12 to remove debris.

When the casting cavity 28 is full, molten casting material 32 may accumulate in the sprue 42, at which point the stopper rod 20 is lowered and pouring stops. As the pouring table 22 indexes beneath the body 12 to the next adjacent casting cavity 28, any casting material 32 accumulated in this manner is substantially held within the sprue 42 until the next adjacent casting cavity 28 is aligned beneath the sprue outlet 46, at which point the accumulated material is released into the empty casting cavity 28.

Those of ordinary skill in the art will recognize that with the present invention, the material normally wasted in filling the integral funnel associated with a first casting cavity is instead directed to the next casting cavity. It will also be recognized by comparing a conventional integral funnel 52 (shown in FIG. 3) with the movable pouring basin 10 of the present invention (shown in FIG. 4), that placing the sprue 42 above the upper surface 26 of the mold halves 24 allows greater head pressure to be developed, which in turn allows for a greater portion of the mold halves 24 to be used as a casting cavity 28.

To reduce the likelihood that an overpour will infect an advancing casting cavity 28 moving in the direction shown in FIG. 1, a portion 54 of the top surface 40 of the body 12 at the sprue inlet 44 is recessed in order to provide access to an overflow channel 56 adapted to capture, and safely release, excess molten casting material 32.

In a preferred embodiment, the depth of the overflow channel 56 increases as the channel 56 extends away from the sprue inlet 44. An outlet passage 58 permits the overflow to safely escape from the rear of the movable pouring basin 10 rather than toward advancing casting cavities 28.

When operation of the production line is suspended or stopped, the pneumatic device 36 may be used to lift the body 12 off the flat upper surface 26 of the mold halves 24 to allow excess molten casting material 32 to drain out of the sprue 42.

While preferred embodiments of the invention have been shown and described, it will be understood by persons skilled in the art that various changes and modifications may be made without departing from the spirit and scope of the invention which is defined by the following claims.

What is claimed is:

1. A casting machine comprising:

a source of casting material having an effluent outlet;

at least one mold element defining a casting cavity with an inlet;

a movable pouring basin disposed below and spaced from said source of casting material and interposed said source of casting material and said at least one mold element, said movable pouring basin comprising a body defining a sprue with an inlet for receiving casting material dispensed from the effluent outlet of said source of casting material, and an outlet for directing casting material into the inlet of said casting cavity; and means for aligning said movable pouring basin below the effluent outlet of said source of casting material.

2. A movable pouring basin according to claim 1 wherein said body comprises metal.

3. A movable pouring basin according to claim 2 wherein said body comprises iron.

4. A movable pouring basin according to claim 1 wherein said sprue is lined with a ceramic material.

5. A casting machine comprising:

a source of casting material having an effluent outlet;

a conveyable series of casting cavities defined by a series of mold elements, each said casting cavity having an inlet;

a movable pouring basin comprising a body disposed below and spaced from said effluent outlet adapted for slidable engagement with said mold elements comprising a sprue having an inlet for receiving casting material dispensed from said effluent outlet, and an outlet for sequential alignment above each said inlet of said series of casting cavities for directing casting material into each said inlet; and means for aligning said movable pouring basin below said effluent outlet of said source of casting material.

6. A movable pouring basin according to claim 5 further comprising means for aligning said sprue outlet above each said inlet of said series of casting cavities.

7. A movable pouring basin according to claim 5 wherein said body comprises a generally pointed front profile.

8. A movable pouring basin according to claim 7 further comprising means for removing debris disposed at said front profile.

9. A movable pouring basin according to claim 5 wherein said body has a generally canoe-shaped horizontal cross-section.

10. A movable pouring basin according to claim 5 wherein said body comprises metal.

11. A movable pouring basin according to claim 10 wherein said body comprises iron.

12. A movable pouring basin according to claim 5 wherein said sprue is lined with a ceramic material.

13. A movable pouring basin according to claim 5 wherein said inlet of said sprue is larger than said outlet of said sprue.

14. A movable pouring basin according to claim 5 wherein said sprue is funnel-shaped.

15. A movable pouring basin according to claim 5 wherein said body further comprises a surface defining a casting material overflow channel disposed adjacent to said inlet of said sprue to permit overflow casting material to escape from said body.

16. A movable pouring basin according to claim 5 further comprising an arm pivotally connected between said body and said source of casting material.

17. A movable pouring basin according to claim 16 further comprising means to assist in pivotal motion of said arm.

18. A movable pouring basin according to claim 17 wherein said assisting means comprise a pneumatic device.

19. A casting machine comprising:

(a) a source of casting material having an effluent outlet;

(b) a conveyable series of mold elements defining a series of casting cavities having inlets for sequential alignment beneath said effluent outlet;

(c) a movable pouring basin spaced from and positioned below said effluent outlet comprising a body adapted for movable engagement with said mold elements, said body comprising a sprue having an inlet for receiving casting material from said effluent outlet, and an outlet for sequential alignment above each said inlet of said series of casting cavities and for directing casting material into said inlets; and (d) means for maintaining said inlet of said sprue in alignment with said effluent outlet.

20. A casting machine according to claim 19 wherein said body comprises a generally pointed front profile.

21. A casting machine according to claim 19 wherein said body has a generally canoe-shaped horizontal cross-section.

22. A casting machine according to claim 19 wherein said body comprises iron.

23. A casting machine according to claim 19 wherein said sprue is lined with a ceramic material.

24. A casting machine according to claim 19 wherein said sprue is funnel-shaped.

25. A casting machine according to claim 19 wherein said body further comprises a surface defining a casting material overflow channel disposed adjacent to said inlet of said sprue to permit overflow casting material to escape from said body.

26. A casting machine according to claim 19 further comprising an arm pivotally connected between said body and said source of casting material.

27. A casting machine according to claim 26 further comprising means to assist in pivotal motion of said arm.

28. A casting machine according to claim 27 wherein said assisting means comprise a pneumatic device.

* * * * *